US006179186B1

(12) United States Patent
Blanking

(10) Patent No.: US 6,179,186 B1
(45) Date of Patent: Jan. 30, 2001

(54) BACKPACK

(75) Inventor: Jonas Blanking, Malmö (SE)

(73) Assignee: Global Act AB (SE)

( * ) Notice: Under 35 U.S.C. 154(b), the term of this patent shall be extended for 0 days.

(21) Appl. No.: 09/344,506

(22) Filed: Jun. 25, 1999

Related U.S. Application Data

(63) Continuation of application No. PCT/SE97/02032, filed on Dec. 5, 1997.

(60) Provisional application No. 60/035,766, filed on Jan. 6, 1997.

(51) Int. Cl.[7] ..... A45F 3/04

(52) U.S. Cl. ..... 224/629; 224/153

(58) Field of Search ..... 224/629, 645, 224/153; D3/216, 217; 150/130; 190/127

(56) References Cited

U.S. PATENT DOCUMENTS

| | | | |
|---|---|---|---|
| D. 214,476 | 6/1969 | Maxwell . | |
| D. 249,188 | 8/1978 | Stewart . | |
| D. 355,297 | 2/1995 | Ash, Jr. . | |
| D. 404,909 | 2/1999 | Fichter . | |
| 3,064,867 | 11/1962 | Pinkham et al. . | |
| 3,622,056 | 11/1971 | Droeger . | |
| 3,679,108 | 7/1972 | Ingram . | |
| 3,846,855 | 11/1974 | Peterson . | |
| 3,902,640 | 9/1975 | Geiben . | |
| 3,960,300 | 6/1976 | Dickler . | |
| 4,088,252 | 5/1978 | Grunberger . | |
| 4,420,103 | 12/1983 | Douglass . | |
| 4,750,654 | 6/1988 | Menetrier . | |
| 5,004,135 | 4/1991 | Dufournet et al. . | |
| 5,255,834 | 10/1993 | Bendersky . | |
| 5,320,262 | 6/1994 | Levis . | |
| 5,370,287 | 12/1994 | Cormier . | |
| 5,573,155 | 11/1996 | Sadler . | |
| 5,634,576 * | 6/1997 | Arbel | 224/629 |
| 5,890,640 | 4/1999 | Thompson . | |

FOREIGN PATENT DOCUMENTS

| | | |
|---|---|---|
| 33 23 763 | 1/1985 | (DE) . |
| 0 328 470 | 8/1989 | (EP) . |
| 0 503 075 | 9/1992 | (EP) . |
| 0 744 138 | 11/1996 | (EP) . |
| 0748599 A1 | 12/1996 | (EP) . |
| 2 646 998 | 11/1990 | (FR) . |
| 503 774 | 6/1996 | (SE) . |
| WO 97/17866 | 5/1997 | (WO) . |

* cited by examiner

*Primary Examiner*—Stephen K. Cronin
*Assistant Examiner*—Maerena W. Brevard
(74) *Attorney, Agent, or Firm*—Smith, Gambrell & Russell, LLP

(57) ABSTRACT

A backpack has a casing surrounding a space with the casing having a front wall which is intended to be facing the back of a carrier and is a flexible wall directly adjoining the space. The casing also has a dimensionally stable shell extending from the front wall, which together with the front wall surrounds the space.

35 Claims, 3 Drawing Sheets

BACKPACK

REFERENCE TO RELATED APPLICATIONS

This is a continuation of International Application PCT/SE97/02032 filed Dec. 5, 1997, which was based on U.S. Provisional Application No. 60/035,776 filed Jan. 6, 1997.

FIELD OF THE INVENTION

The present invention relates to a backpack as set forth in the preamble to the appended claim 1.

BACKGROUND OF THE INVENTION

Conventional backpacks usually have a sack made of a flexible material and comprise a front side facing a carrier, which side is either soft or comprises a frame. Such backpacks are suitable for carrying soft and durable objects, such as clothing, but they are less suitable for many other cumbersome and fragile objects, such as papers, books, binders, portable computers, and cameras. There are particular problems when the backpack is used in connection with various activities where there is a risk that the backpack will be subjected to blows and knocks.

There are also backpacks which comprise a dimensionally stable container for holding various objects. When the backpack is formed as a dimensionally stable container, e.g. from plastic, comfort problems arise. It is uncomfortable to carry a hard container directly against one's back. There have been various attempts to solve this problem.

U.S. Pat. No. 3,902,640 discloses a backpack which is made of a semi-rigid material throughout. For ease of carrying, the front side of the backpack has been given a curved profile in order to adapt it to the back of a carrier to a certain extent. However, neither does this construction achieve a backpack which is particularly comfortable to carry, especially for individuals whose body shape deviates from the shape to which the backpack is adapted.

U.S. Pat. No. 3,679,108 discloses a rigid "backbox", which has an inflatable air cushion facing the back of the carrier. A mouldable surface is formed against the carrier, but the "backbox" becomes cumbersome and is hardly comfortable to carry for a long period of time. In addition, the construction shown presents a clear risk of the carrier being injured by sharp corners and edges of the "backbox", e.g. in the case of a fall.

SE 503,777 describes a portable storage device with a dimensionally stable container and a separate harness, which has its own dimensionally stable back piece forming a surface for the carrier in front of the container. This construction also becomes cumbersome and difficult to adapt to carriers of various body shapes and creates a risk of the carrier being injured, e.g. in the case of a fall.

The two latter constructions have the drawback that they are difficult to carry with a heavy load, since the centre of gravity ends up being low and too far behind the carrier.

Carrying objects on one's back is ergonomically correct, relatively comfortable, and less tiring than carrying objects in other ways. There is thus a need for an improved type of backpack which is easy to handle and which, moreover, enables the carrying of objects which in many situations are presently unsuitable for carrying in existing types of backpack.

SUMMARY OF THE INVENTION

The object of the present invention is to provide a backpack, which is an improvement on the known constructions described above.

In this connection, a particular object is to provide a backpack which is suitable for carrying fragile objects and which at the same time is comfortable and easy to handle.

These and other objects, which can be seen from the description below, have now been achieved by the invention by means of a backpack which is of the type described in the introductory part and which, in addition, has the features recited in the characterising part of claim 1.

Thus, the backpack according to the invention has a casing which surrounds a space.

The casing has a flexible front wall, which directly adjoins the space and is intended to be facing the back of a carrier. In this way, a backpack is provided which is comfortable to carry by virtue of the fact that the front wall can conform to the shape of the carrier's back and which, moreover, by virtue of the absence of dimensionally stable panels facing the back of the carrier, is lightweight and easy to handle and carry.

The casing has a dimensionally stable shell means extending from the front wall. In this way, a space is extended which maintains its shape and volume regardless of whether or not an object is placed in the space. In this connection, it is possible for a carrier to pack fragile objects, as well as to carry these objects in a safe and comfortable manner.

Making the side of the casing facing the back flexible and making the rest of the walls defining the space rigid, takes advantage of the fact that the carrier's back constitutes an essentially flat surface and thus only achieves small curvatures and little action upon the front wall in connection with carrying. At the same time, the flexible wall in a simple way permits formation in accordance with the back of a carrier, resulting in good ease of carrying.

In connection with the invention, a flexible wall refers to a pliable or formable wall with no substantial rigidity or ability in itself to maintain a given shape when being acted upon by an external force. In connection with the invention, a dimensionally stable shell means refers to a shell means capable of maintaining its given shape despite being acted upon by a certain degree of external force.

Preferred embodiments of the invention are stated in the subclaims.

In a preferred embodiment, a lower portion of the front wall is connected to a lower portion of the shell means. By the fact that the connection between the rigid shell means and the flexible front wall is arranged along a portion, i.e. an extent with a certain area, in the lower area of the casing instead of along an edge, one avoids uncomfortable and dangerous edges cutting into the back of the carrier in the area where the horizontally acting forces between the backpack and the carrier are the greatest. In this connection, it is a particularly preferred feature that the lower portion of the shell means, which portion is connected to the front wall, comprises a supporting surface arranged along the front wall for resting against a carrier.

In a particularly preferred embodiment, the lower portion of the shell means, which portion is connected to the front wall, has a backwardly curved portion below the supporting surface. In this way, good adaptation is achieved to the shape of the lower part of the back in different people, while the lower edge of the shell means faces away from the carrier, whereby the risk of injury in connection with blows and knocks is avoided.

In a particularly preferred embodiment the shell means is detachably connected to the other parts of the backpack. In this way, the backpack can be divided into one rigid part and one flexible part.

According to one aspect of the invention, it comprises a backpack with a casing which has one soft or flexible part and one rigid or hard part. The rigid part comprises a shell means which in the downward, backward, and sideways directions defines a space in the backpack. The soft part comprises the front wall of the space, which at the same time forms a back panel facing the back of a carrier, and carrying straps connected thereto. The shell means is directly connected to the lower portion of the front wall. Moreover, the shell means has upper front portions which are connected to the front wall, either directly thereto or by the intermediary of wall portions associated with the soft part, which form part of the side walls of the space. It is of substantial importance to the invention that the shell means is considerably more rigid than the front wall.

BRIEF DESCRIPTION OF THE DRAWINGS

By way of an example, the invention will be described in more detail below with reference to the accompanying drawings, which show a presently preferred embodiment of the invention.

DESCRIPTION OF A PREFERRED EMBODIMENT

Figure 2:
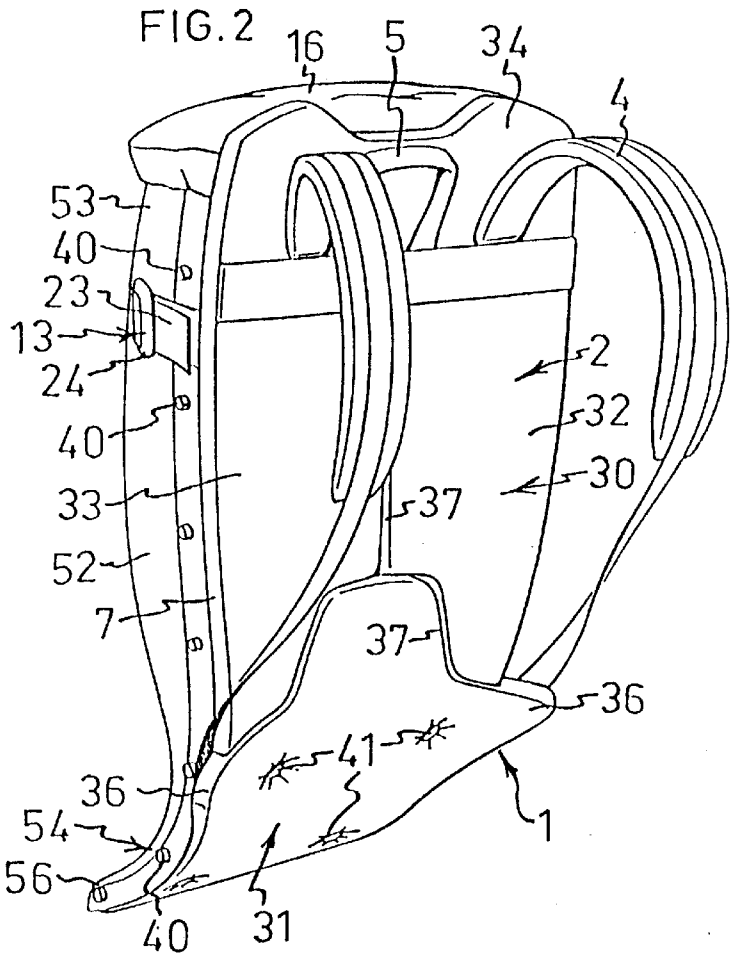
FIG. 2 shows the backpack according to FIG. 1 in a view obliquely from the front.
Figure 1:
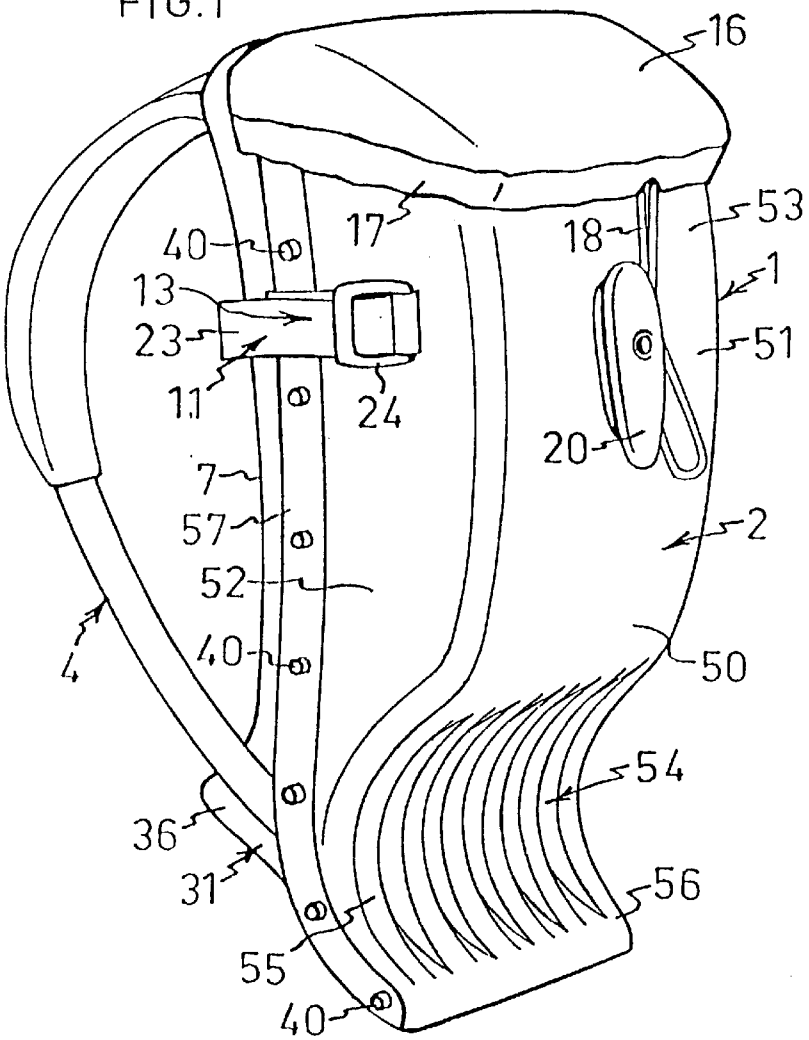
FIG. 1 shows a backpack according to the invention in a view obliquely from behind.

FIGS. 1 and 2 show a backpack 1 according to the invention in a front view and a rear view respectively. In connection with the invention, different reference directions refer to the backpack as it is intended to be aligned when it is carried on the back of a carrier. The backpack 1 comprises a casing 2 and carrying straps 4 connected thereto.

The casing 2 defines a space 26 (see FIG. 3) and comprises a front wall in the form of a flexible back panel 30 facing a carrier and a dimensionally stable, self-supporting shell means 50 connected to the back panel 30.

The shell means 50 is formed in one single piece out of a dimensionally stable material, e.g. metal, injection-moulded plastic or a fibre reinforced plastic material, and can be said to comprise three essential wall portions, viz. a rear wall portion 51 and two opposite side-wall portions 52. The rear wall portion 51 has an S-shaped longitudinal section and in that way defines a space in the upper portion 53 of the shell means 50 and forms a gently rounded portion against the carrier in the lower portion 54 of the shell means 50. The lower portion 54 of the shell means 50 comprises a supporting surface 55 for a carrier, as well as a backwardly curved portion 56 below the supporting surface 55. The lower portion 54 is corrugated for achieving greater strength. Towards the front, the rear wall portion 51 merges into the side-wall portions 52, which in turn end in a slightly concave, forward-facing edge 57 (see FIG. 6) adjacent to the upper area of the wall portion 51 and in a stiffening flange along the wall portion 51 in the lower area 54 of the same. A major advantage of the open design of the shell means, shown in the embodiment, with soft edges and corners, is that the shell means can be made in a single step, e.g. by means of injection moulding.

The back panel 30, which is pliable but not extensible, comprises four portions, a lower lumbar portion 31, two shoulder portions 32, 33 juxtaposed thereabove, as well as an upper portion 34. These four portions comprise one padding panel each, e.g. of polyethylene with a thickness of about 15 mm. The padding panels, each of which is pliable, are held in place by external and internal textile materials and seams 37 arranged between the panels. The back panel 30 may also comprise a single padding panel divided into portions by the seams. By virtue of the padding of the back panel, any hard or angular objects in the space will not cause discomfort when the backpack is carried.

On the whole, the back panel 30 exhibits greater pliability along the lines (the seams 37) where the portions 31, 32, 33 adjoin. In the middle, the lumbar portion 31 extends part way up between the shoulder portions 32, 33. Furthermore, the lumbar portion 31 is connected to the lower portion 54 of the shell means 50 with the aid of screws 41 and nuts for forming a supporting surface for the carrier. The screws 41 are recessed in the padding of the lumbar portion 31 and on the back (outside) of the shell means 50 extend into the respective corrugated parts in order not to be in the way on one of the sides. In their sides 7, the shoulder portions 32, 33 are connected to the shell means 50 with the aid of connection means 11, as will be described in more detail below. By the assembly and configuration shown and described above, a back panel 30 is achieved which in coaction with a rigid shell means 50 comfortably conforms to the back of a carrier.

The upper ends of the carrying straps 4 are connected to the upper area of a respective shoulder portion 32, 33 while the lower ends are connected to the outer edges of the lumbar portion 31 of the back panel 30 adjacent to the lower portion 54 of the shell means 50. The lumbar portion 31 is curved outwards somewhat for forming tabs 36 adjacent to the attachment point of the carrying straps 4 in order to hold the lower ends of the carrying straps 4 out laterally, so that a comfortable fit against the carrier is achieved. A carrying handle 5 is arranged between the upper attachment points of the carrying straps 4.

Figure 3:
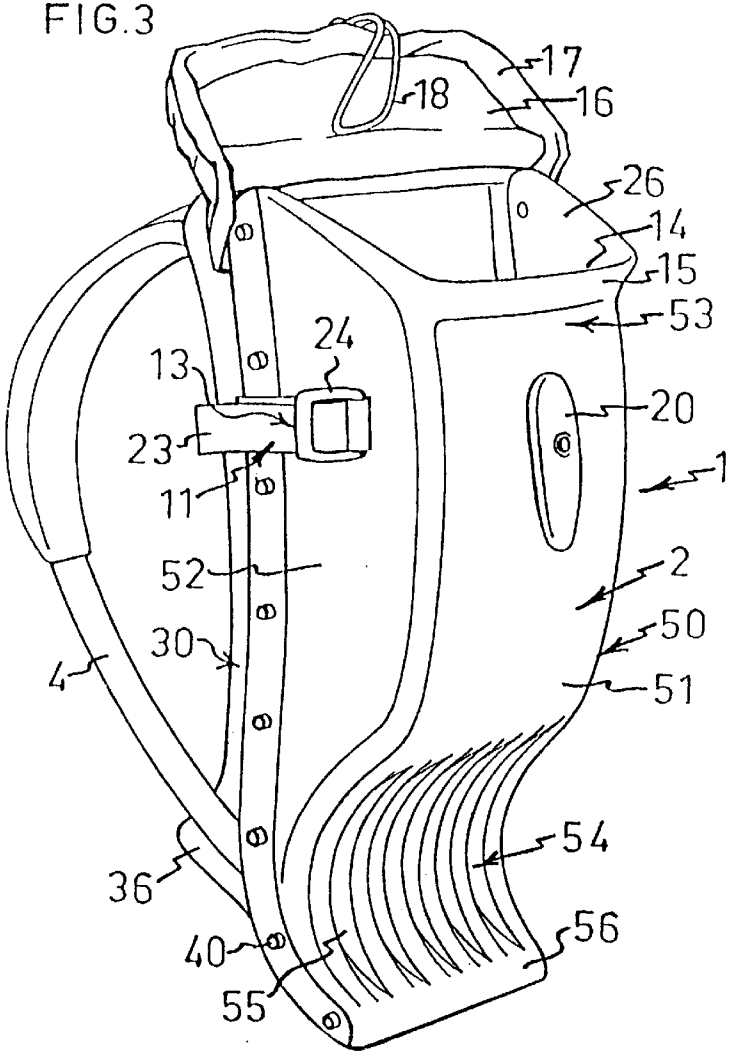
FIG. 3 shows the backpack according to FIG. 1 in an opened position.

The backpack 1 has a flexible cover 16 made of fabric which along a front edge connects to the back panel 30 and which in a closed position (FIGS. 1 and 2) covers an upper opening between the back panel 30 and the upper edge of the shell means 50. FIG. 3 shows the backpack 1 with the cover 16 open. Along the circumference 17 of the cover 16, a cord 18 runs in a channel in the cover 16 and extends out from the channel in an opening in the rear portion of the cover 16. By using the cord 18, which may be elastic, the dimension of the circumference of the cover 16 can be reduced to varying degrees by pulling the cord 18 out of the channel different distances. Naturally, the cord 18 does not have to extend along the entire circumference of the cover 16, but only along a portion of the same. A locking means of a conventional type (not shown) can be arranged around the cord outside the cover to prevent the cord, when in an extended position, from being pulled into the channel so that the circumferential dimension of the cover increases.

In its upper area, the shell means 50 has a backwardly or outwardly curved upper portion 15, which ends in an upper edge 14. The outwardly curved edge 14 serves two purposes. Firstly, the cover 16 can be closed by being pulled over the backwardly curved, upper portion 15 of the shell means 50, after which the cord 18 is tightened and fixed in the pulled-out position, either by a locking means described above or by a locking means arranged on the shell means, in this case in the form of a cleat 20. Secondly, the outwardly curved upper portion 15 and the backward-facing upper edge 14 prevent injuries to a carrier caused by the edge of the rigid shell means 50, e.g. in the case of a fall in connection with skiing or bicycling.

Figure 4:
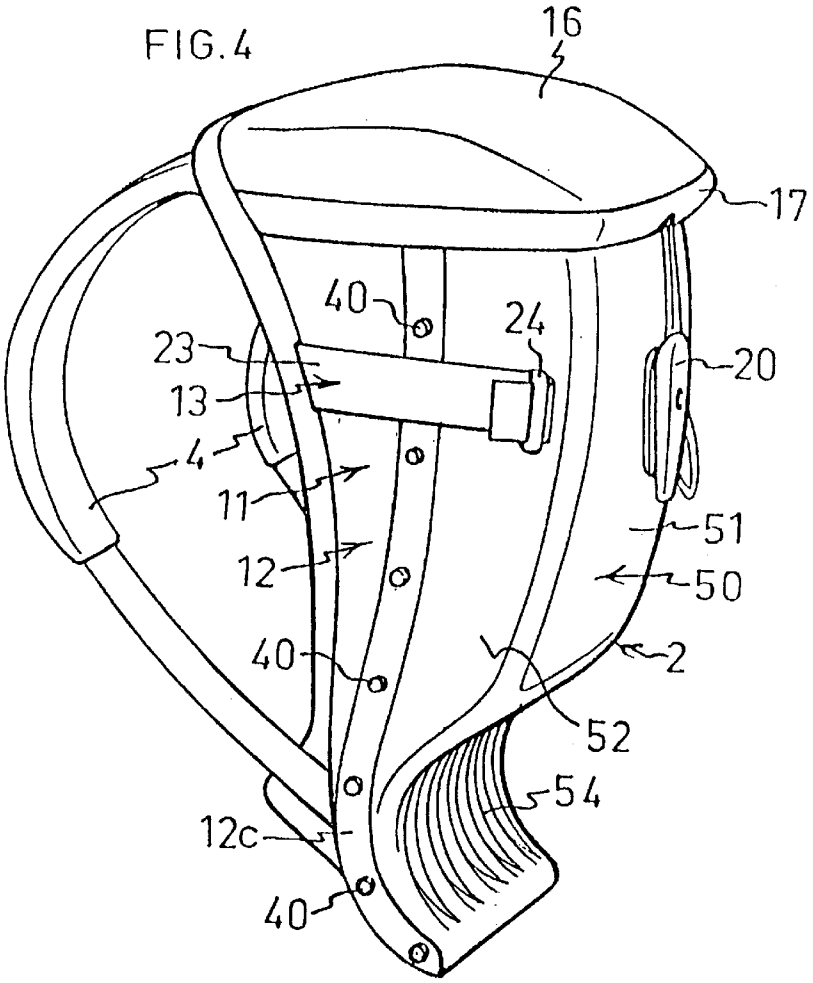
FIG. 4 shows the backpack according to FIG. 1 in an expanded position.
Figure 5:
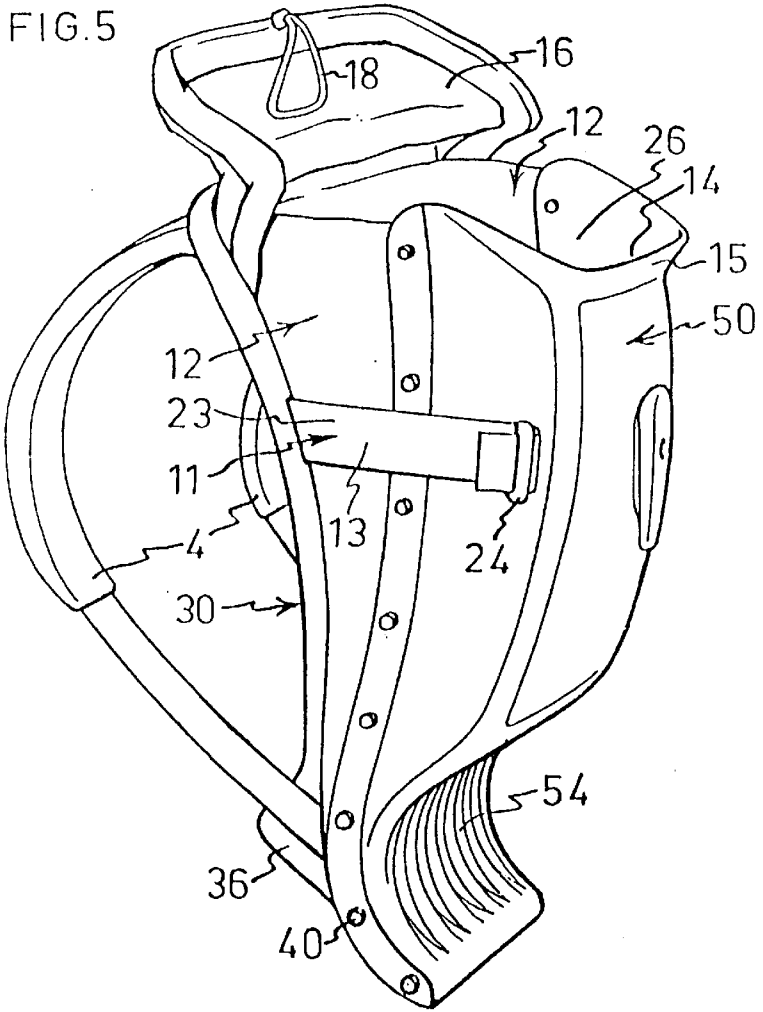
FIG. 5 shows the backpack according to FIG. 1 in an opened and expanded position.

FIGS. 4 and 5 show the backpack 1 in an expanded state with a closed and an open cover 16 respectively. As described above, the back panel 30 is connected to the shell means 50 by the intermediary of a common lower portion and by the intermediary of connection means 11 arranged on the sides. Each of these connection means 11 comprises a strapping means 13, which is also shown in FIGS. 1–3 and which comprises a strap 23 and a locking means in the form of a buckle 24. With the aid of this strapping means 13 it is possible, above and at a distance from the lower portion 54 of the shell means 50, to adjust the distance between the back panel 30 and the shell means 50.

In addition to the strapping means 13, each connection means 11 comprises a downwardly tapering, wedgeshaped portion 12 made of fabric or some other flexible material. By its front edge, the wedge-shaped portion 12 is fixedly connected to the back panel 30, and along its rear edge portion 12*a* (see FIG. 6) it is detachably connected to the shell means 50 at the front edge 57 of the same with the aid of screws 40 and nuts or other suitable means. The rear edge portion 12*a* of the wedge-shaped portion 12 is provided with a sealing material 12*b* (see FIG. 6) on its side facing the shell means 50 and is provided with a rigid strip 12*c* on its outside. Consequently, a watertight connection is formed between the wedge portion 12 and the shell means 50.

When the strapping means 13 is adjusted to the maximum distance between the shell means 50 and the back panel 30, the wedge-shaped portion forms front side walls of the space 26. Despite being flexible (although not extensible), the wedge-shaped portion 12 will be expanded between the back panel 30 and the shell means 50 when the backpack is sufficiently full.

Preferably, the backpack according to the embodiment has a bottom means (not shown) with a wedge-shaped cross-section to be placed in the bottom of the space 26 and thereby to form a flat bottom surface. The bottom means is preferably made of foam plastic and is detachable to allow increased space volume if necessary. In an alternative embodiment (not shown), the bottom means may comprise a panel which is articulated to the inside of the front wall, e.g. of 15 mm polyethylene, and which rests against a supporting edge on the inside of the shell means for forming a flat bottom surface.

Figure 6:
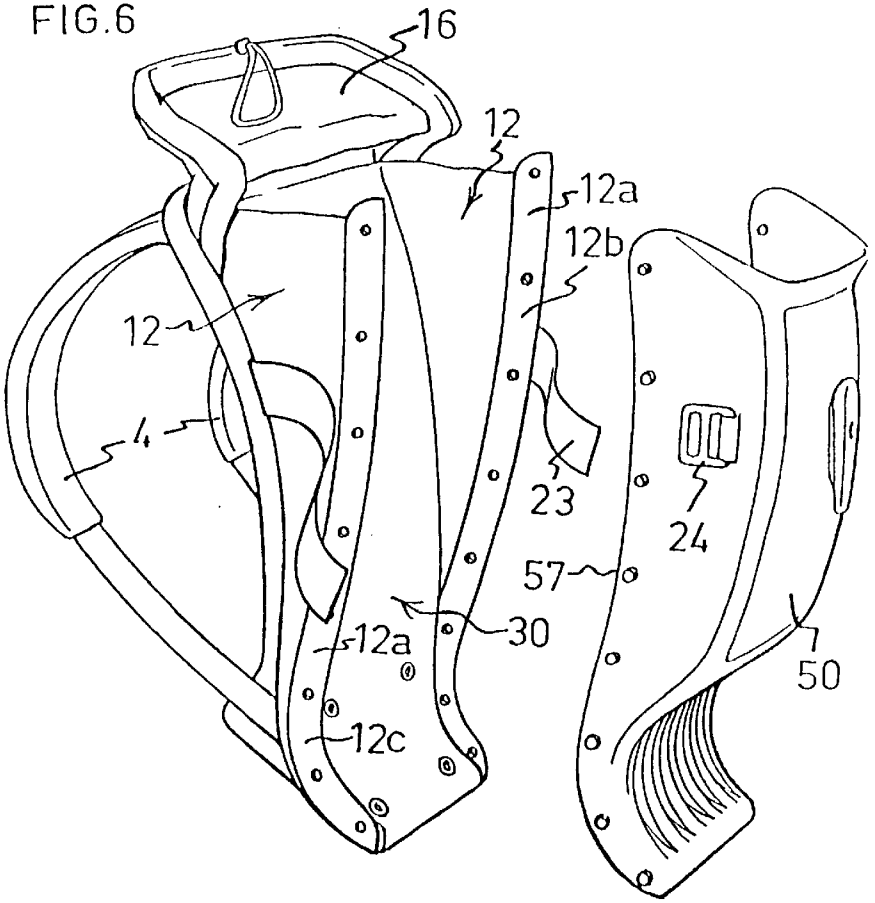
FIG. 6 shows the backpack according to FIG. 1 in a disassembled state.

FIG. 6 shows the backpack with the shell means 50 separated from the back panel 30 with associated parts 4, 12, 16. Accordingly, the backpack can be divided into one flexible part and one hard or rigid part. In this way, it is possible, for instance, to wash the flexible parts, which in addition to padding comprise fabric. Moreover, it is possible to replace a rigid part if it has been deformed, e.g. in an accident.

Thus, by the preferred embodiment of the invention described herein, a backpack has been provided which has a large number of advantages and new features compared to previously known constructions. Accordingly, it is possible in a simple manner to attach various fastener means in the rigid shell means to permit various objects to be carried on the outside of the backpack. In this connection, the concave lower portion 54 of the back (outside) of the shell means 50 is particularly suited to hold objects, such as a sleeping bag.

Another major advantage of the backpack is that, by virtue of the shape of the shell means, it distributes the centre of gravity of a load in the backpack high up on and close to the carrier.

What is claimed is:

1. A backpack comprising a casing (2), having a front wall (30), which is intended to be facing the back of a carrier, and wall portions (50) extending backwards from the front wall (30), which together with the front wall (30) surround a space (26), and characterised in that the front wall (30) is a flexible wall, directly adjoining the space (26) so that one wall defining space is said flexible wall and the wall portions of the casing (2) which extend from the front wall (30) comprise a dimensionally stable shell (50) being formed of a rigid material such that said shell protects fragile objects from impact forces when fragile objects are positioned in the space.

2. A backpack according to claim 1, wherein side edges (7) of the front wall (30) are connected to an upper portion (53) of the shell (50), and a lower portion (31) of the front wall (30) is connected to a lower portion (54) of the shell (50).

3. A backpack according to claim 2, wherein the lower portion (54) of the shell (50), which portion is connected to the front wall (30), comprises a supporting surface (55) arranged along the front wall (30) for resting against a carrier.

4. A backpack according to claim 3, wherein the lower portion (54) of the shell (50), which portion is connected to the front wall (30), has a backwardly curved portion (56) below the supporting surface (55).

5. A backpack according to claim 1, wherein front edges (57) of the shell (50) are connected to side edges (7) of the front wall (30) with the aid of connection means (11), which enables an adjustment in size of the space (26) by changing an interrelation between the front wall (30) and the shell (50).

6. A backpack according to claim 5, wherein the connection means (11) comprises a downwardly tapering, wedge-shaped portion (12) made of a flexible material.

7. A backpack according to claim 5, wherein the connection means (11) comprises strapping means (13), which, above and at a distance from the lower portion (54) of the shell (50), enables the adjustment of the distance between the front wall (30) and the shell (50).

8. A backpack according to any claim 1, wherein the shell (50) has an upper edge (14), which is arranged on an upper, outwardly curved portion (15).

9. A backpack according to claim 8, wherein a flexible cover (16) extends backwards from the upper portion of the front wall (30), the dimension of at least a circumferential portion (17) of the cover (16) being changeable and the cover (16) being attachable to the shell (50) by coaction between the outwardly curved portion (15) and the changeable circumferential dimension.

10. A backpack according to claim 1, wherein the front wall (30) is padded.

11. A backpack according to claim 1, wherein the shell (50) is formed in one single piece.

12. A backpack according to claim 1, wherein the shell (50) is detachably connected to other parts of the backpack, with the backpack being divisible into one rigid part and one flexible part.

13. A backpack according to claim 1, further comprising carrying straps connected to said casing.

14. A backpack according to claim 1, wherein the rigid shell comprises a rear wall and two side walls extending from said rear wall, with each of said side walls having a concave forward-facing edge.

15. A backpack according to claim 1, wherein the rigid shell is formed is a single, continuous unitary member formed of a material selected from the group consisting of metal, hardened molded plastic, or hardened reinforced plastic material.

16. A backpack as recited in claim 1 further comprising a flexible cover extending from an upper portion of said flexible front wall for positioning over an upper opening defined by said shell.

17. A backpack as recited in claim 16 further comprising a strap assembly connected to an upper portion of said flexible front wall.

18. A backpack as recited in claim 17 further comprising an elastic member positioned along a peripheral edge of said cover and said shell having a flanged upper edge for receiving and retaining the elastic member so as to hold the cover in a covering state.

19. A backpack, comprising:

a casing having a flexible front wall and a dimensionally stable shell connected with said flexible wall, with said flexible front wall and dimensionally stale shell defining an interior object carrying space, said flexible front wall directly adjoining the interior object carrying space and being arranged, in use, to contact and conform to a back of a carrier, and said shell being a rigid shell which maintains a given, initial shape despite being subjected to external forces; and a strap assembly secured to said casing.

20. A backpack as recited in claim 19, wherein said shell comprises a rear wall portion and two opposite side wall portions.

21. A backpack as recited in claim 20 wherein said rear and two opposite side wall portions are formed of as one single piece of rigid plastic material.

22. A backpack as recited in claim 20 wherein said two opposite side wall portions each have a concave forward facing edge.

23. A backpack as recited in claim 19 wherein the shell is a single, continuous, unitary member formed of a material selected from the group consisting of metal, hardened injection molded plastic, or hardened fibre reinforced plastic material.

24. A backpack as recited in claim 19 wherein said shell has a bottom edge in a direct connection state with a padded lower portion of said flexible front wall such that, in use, the padded lower portion of said flexible front wall avoids direct contact between the bottom edge of said shell and the carrier.

25. A backpack as recited in claim 19 wherein said shell has an upper edge section defining an open top portion in said casing and said backpack further comprising a flexible cover which extends over the open top portion of the casing when in a covering state.

26. A backpack as recited in claim 25 wherein the upper edge section of said shell includes a flanged section over which a peripheral portion of said cover extends.

27. A backpack as recited in claim 26 wherein said flanged section includes an outwardly curved section and said cover having an elastic edge designed for a snap fit below said outwardly curved section.

28. A back pack as recited in claim 19 wherein said shell comprises a rear wall portion and two opposite side wall portions, and said rear wall portion has an S-shaped longitudinal section.

29. A backpack as recited in claim 19 wherein said strap assembly includes a pair of straps that are connected to said flexible wall.

30. A backpack as recited in claim 19 wherein said shell has an upper portion and a lower portion and said casing further comprising expandable connection means for connecting said shell to said flexible front wall such that an upper portion of said shell is expandable out away from said flexible front wall positioned for contact with a back of a carrier.

31. A backpack as recited in claim 19 wherein said flexible front wall is detachably connected to said shell with detachable connection means.

32. A backpack as recited in claim 19 wherein said shell has opposite side walls with free edges and said flexible front wall is connected to and extends fully between said free edges.

33. A backpack comprising a casing (2), having a front wall (30), which is intended to be facing the back of a carrier, and wall portions (50) extending backwards from the front wall (30), which together with the front wall (30) define a space (26), and carrying straps (4), which are connected to the casing (2), characterised in that the front wall (30) is a flexible wall, directly adjoining the space (26) and the wall portions of the casing (2) which extend from the front wall (30) comprise a dimensionally stable shell (50) extending from the front wall, and wherein side edges (7) of the front wall (30) arc connected to an upper portion (53) of the shell (50), and a lower portion (31) of the front wall (30) is connected to a lower portion (54) of the shell (50);

wherein the lower portion (54) of the shell (50), which portion is connected to the front wall (30), comprises a supporting surface (55) arranged along the front wall (30) for resting against a carrier; and wherein the lower portion (54) of the shell, which portion is connected to the front wall (30), has a backwardly curved portion (56) below the supporting surface (55).

34. A backpack comprising a casing (2), having a front wall (30), which is intended to be facing the back of a carrier, and wall portions (50) extending backwards, from the front wall (30), which together with the front wall (30) define a space (26), and carrying straps (4), which are connected to the casing (2), characterised in that the front wall (30) is a flexible wall, directly adjoining the space (26) and the wall portions of the casing (2) which extend from the front wall (30) comprise a dimensionally stable shell (50) extending from the front wall, and wherein front edges (5) of the shell (50) are connected to side edges (7) of the front wall (30) with the aid of connection means (11), which enables an adjustment of the size of the space (26) by changing an interrelation between the front wall (30) and the shell (50).

35. A backpack according to claim 34, wherein a flexible cover (16) extends backwards from the upper portion of the front wall (30), the dimension of at least a circumferential portion (17) of the cover (16) being changeable and the cover (16) being attachable to the shell means (50) by coaction between the outwardly curved portion (15) and the changeable circumferential dimension.

* * * * *